US005517909A

United States Patent [19]

Samejima et al.

[11] Patent Number: 5,517,909

[45] Date of Patent: May 21, 1996

[54] PRESS MACHINE HAVING REINFORCED SIDE FRAMES

[75] Inventors: Tairo Samejima; Kikuo Ejima; Shigeki Honda; Kenji Nishikawa; Kazuya Imamura; Kazuhisa Suzuki; Hiroyasu Suda, all of Kanagawa; Yoshitaka Nishihara; Hirohide Sato, both of Ishikawa, all of Japan

[73] Assignee: Kabushiki Kaisha Komatsu Seisakusho, Tokyo, Japan

[21] Appl. No.: 305,302

[22] Filed: Sep. 15, 1994

Related U.S. Application Data

[63] Continuation-in-part of Ser. No. 237,337, May 3, 1994, abandoned, which is a continuation of Ser. No. 956,770, Dec. 17, 1992, abandoned.

[30] Foreign Application Priority Data

| | | | |
|---|---|---|---|
| Jun. 20, 1990 | [JP] | Japan | 2-159983 |
| Jun. 20, 1990 | [JP] | Japan | 2-159984 |
| Jun. 20, 1990 | [JP] | Japan | 2-159985 |
| Oct. 5, 1990 | [JP] | Japan | 2-104516 |
| Jun. 20, 1991 | [WO] | WIPO | PCT/JP91/00834 |

[51] Int. Cl.[6] ..... B30B 15/04

[52] U.S. Cl. ..... 100/231; 72/455; 83/859; 100/299

[58] Field of Search ..... 100/214, 231, 100/299; 72/455, 456; 83/859

[56] References Cited

U.S. PATENT DOCUMENTS

| | | | |
|---|---|---|---|
| 1,389,879 | 9/1921 | Kraut | 83/859 |
| 2,512,246 | 6/1950 | Fishburne | 100/231 |
| 2,580,078 | 12/1951 | Dension, Jr. | 100/231 |
| 2,745,338 | 5/1956 | Wissman | 100/214 |
| 3,884,142 | 5/1975 | Jonsson | 100/231 |

FOREIGN PATENT DOCUMENTS

| | | | |
|---|---|---|---|
| 133920 | 1/1979 | Germany | 100/214 |
| 144024 | 9/1980 | Germany | 100/231 |
| 145207 | 11/1980 | Germany | 100/214 |
| 38-2945 | 4/1963 | Japan . | |
| 52-20479 | 2/1977 | Japan | 100/231 |
| 55-46399 | 10/1980 | Japan . | |
| 56-148500 | 11/1981 | Japan . | |
| 56-148499 | 11/1981 | Japan | 100/214 |
| 62-13759 | 4/1987 | Japan . | |
| 301779 | 12/1928 | United Kingdom | 100/231 |

OTHER PUBLICATIONS

"Proceedings of the 1989 Meeting": *The Institute of Noise Control Engineering of Japan;* Sep. 1989.

Werkstatt Und Betrieb, vol. 91, No. 4, Apr. 1958, Muchen de pp. 177–180. G. Oehler; "Zur Gestellberechnung hydraulischer Pressen", p. 178.

*Primary Examiner*—Stephen F. Gerrity
*Attorney, Agent, or Firm*—Ronald P. Kananen

[57] ABSTRACT

A press machine having side frames which are effectively reinforced so as to appreciably reduce the noise generated during operation of the machine and improve the working accuracy of the machine without installing any special device on the outside thereof, significantly increasing the weight of the entire press machine, or obstructing a space between the side frames of the press machine. The side frames of the press machine are C-shaped in side view and are reinforced by at least one reinforcing member fixedly secured to each of the side frames at at least one predetermined place. The reinforcing members function to suppress the deformation of the opening of the C-shaped side frames to reduce noise and improve accuracy. The reinforcing members convert the vibrational energy of the side frames into heat energy which is then absorbed into the side frames.

8 Claims, 6 Drawing Sheets

PRIOR ART EXAMPLE

PRIOR ART EXAMPLE

PRIOR ART EXAMPLE

PRESS MACHINE HAVING REINFORCED SIDE FRAMES

This application is a continuation-in-part of application Ser. No. 08/237,337 filed May 3, 1994 (abandoned), which is a continuation of application Ser. No. 07/956,770 filed Dec. 17, 1992, now abandoned.

BACKGROUND OF THE INVENTION

1. Technical Field of the Invention

This invention relates to a press machine having a frame which is C-shaped in side elevational view, a bolster which is mounted on a bed of a lower jaw portion of the frame, and a slide which is mounted on an upper jaw portion of the frame. More particularly, this invention relates to a press machine whose side frames are reinforced by reinforcing members.

2. Discussion of Related Art

A prior art example of a press machine i to which the present invention relates is shown in FIG. 1. A frame 2 of the press machine 1 is C-shaped in side elevational view, and has a lower jaw portion with a bed 4 supported thereon, and an upper jaw portion with a slide 5 and a driving unit for driving the slide 5 supported thereon. The arrangement is made such that when the slide 5 is lowered by rotation of a main spindle, a workpiece (not shown) positioned on a lower die 7 mounted on a bolster 4*a* resting on the bed 4 is punched by an upper die (punch) 6 fixedly secured to the slide 5. In FIG. 1, reference numeral 3 denotes a front side plate of the frame, and reference numeral 8 denotes a side frame.

In the above-mentioned prior art press machine 1, to suppress or reduce the vibration of the frame 2 or the level of noise generated by the press, for example, either (1) a vibration damping material is mounted on the surface of the frame, or (2) the whole press machine is surrounded by a box to isolate the noise. (Refer, for example, to "Examples of Measures for controlling Noise generated by Press Machines", collection of lectures and thesis on technique presentation conferences issued by Japanese Noise Control Engineering Society, P141, September 1989).

Further, as shown in FIGS. 2 and 3, a third prior art alternative (3) for reducing or suppressing the vibration of the frame or the level of noise generated includes mounting an L-shaped reinforcing plate-shaped member 9 on the inner surface of each of the side frames 8.

The problem with mounting a vibration damping material on the surface of the frame, as in the abovementioned case (1), is that it causes an increase in the weight and cost of the entire press machine. For effective vibration damping, the thickness of the vibration damping material must be at least equal to or more than that of the frame, so that if the thickness of the frame is 22 mm, for example, then the total thickness of the frame and the vibration damping material becomes about 50 mm, thus increasing the weight of the entire press machine, giving disadvantages in terms of cost and practicality.

Further, where the whole press machine is surrounded by a box, as in the above-mentioned case (2), other problems exist relating to press operation, cost and the need for increased working space in factories.

Still further, in the above-mentioned alternative (3), as shown in FIGS. 2 and 3, because the plate-shaped member 9 is fixedly secured to each of the side frames 8 as the reinforcing member thereof, the reinforcing effect for preventing the opening formed between the upper and lower jaws of the frame from flaring was limited. Further, the prior art reinforcing member 9 mounted on the side frames 8 so as to extend upwards from the upper jaw portion is inefficient as a reinforcing member since only a small loading is applied to this portion.

A fourth alternative (4) for reducing or suppressing the vibration of the frame is described in Japanese Patent Publication 55-46399. This alternative uses a pair of tie rods 2 extending between opposite side frames 1, 1' of a press machine. The tie rods 2 are fixed to each side frame by means of a nut 3 and a load plate 4, 5. A preload is applied to the tie rods 2 to reduce or suppress at least certain kinds of vibrations occurring in the side frames during operation. The '399 device uses a vibration damping technique which relies on an increased stiffness of the structure to reduce the vibration amplitude. The vibration energy itself is not dispersed into another form of energy (e.g., heat)—it is just converted into a different amplitude.

The '399 device has significant drawbacks. The arrangement of the tie rods 2 between the side frames substantially limits or interferes with the arrangement of a device or mechanisms disposed inside the press machine. Moreover, the preload strain applied to the press body of the device by the tie rods 2 is disadvantageous because it creates damaging stress in the side frames and tends to disorder the positioning accuracy of the mechanisms within the frame. Thus, the use of the tie rods requires readjustment of the mechanisms for proper performance after securing the tie rods, thereby creating an additional inconvenience. Further, the vibration damping effects of the tie rod arrangement of the '399 device is less than satisfactory because the arrangement is not effective against antisymmetric vibrations of the side frames (i.e., both side frames moving in the same direction in the same phase) during operation of the press machine.

SUMMARY OF THE INVENTION

The present invention has been made in view of the above-mentioned circumstances in the prior art, and has for its principal object to provide a press machine which is effectively reinforced so as to improve the working accuracy of finished products without installing any special device on the outside of the press machine, without extremely increasing the weight of the entire press machine, and without obstructing the space between the side frames, and which is capable of reducing appreciably the level of noise generated by the machine in operation.

To achieve the above-mentioned object, the inventors of the present invention analyzed the vibration and noise generating mechanism of the existing press machines.

In a press machine 1, as shown in FIG. 1, when a slide 5 is lowered by rotation of a main spindle to allow an upper die (punch) 6 fixedly secured to the slide 5 to punch a workpiece (not shown) on a lower die 7 mounted on a bolster 4*a* resting on a bed 4, a frame 2 of the press machine 1 is subjected to a resistance to shearing of the workpiece so that a big magnitude of force is exerted on the frame 2. The big magnitude of force tends to flare the opening formed between the upper and lower jaws of the frame. The workpiece is then cracked and broken suddenly. This breaking of the workpiece causes release of the loading therefrom, thus generating shock, which is propagated to the entire press machine, thereby generating noise and vibration.

Further, when the force is exerted on the frame 2, which tends to flare the opening formed between the jaws thereof, a misalignment occurs between the upper die 6 and the lower die 7, thereby tending to reduce the accuracy of finished products.

FIG. 4 is a graph showing the relationship between punching load and noise (breakthrough noise). As shown by this graph, the lower the punching load, that is, the smaller the amount of deformation or flare of the opening of the frame 2 when the press machine is subjected to the resistance of shearing of the workpiece, the lower the level of noise becomes.

In a press machine with a C-shaped frame, the amount of deformation of the notched portion of the upper jaw portion is the biggest. Consequently, if a reinforcing plate is fixedly secured to this upper jaw portion so as to eliminate the notched portion, then the above-named amount of deformation or flare of the opening of the frame 2 is reduced, thus reducing the breakthrough noise.

Further, as another means for reducing the level of the breakthrough noise, noise generating portions of the press machine may be removed. As a result of experiments, it was found out that the noise generated by the rear, upper portion of the side frames is 20% of the noise generated by the entire press machine making this portion the principal noise generating source. Therefore, the breakthrough noise can be reduced by removing this portion.

The foregoing reveals that if the amount of deformation or flare of the opening of the frame of the press machine is suppressed, the noise level can be reduced, and the accuracy of finished products can be improved. The present invention has been made on the basis of this finding.

To achieve the above-mentioned object, according to a first aspect of the present invention, there is provided a press machine having a frame which is C-shaped in side elevational view, a bolster which is mounted on a lower jaw portion of the frame, and a slide and a drive system for driving the slide which are mounted on an upper jaw portion of the frame, characterized in that a means for suppressing vibrations in the side frames without obstructing a space between the side frames is provided including at least one reinforcing member fixedly secured to each of a pair of side frames forming both sides of the frame at at least one predetermined place so as to suppress the deformation or flare of the opening of the frame.

Further, according to a second aspect of the present invention, there is provided a press machine as set forth in the above-mentioned first aspect, characterized in that the reinforcing member has substantially the same shape as a substantially inverted trapezoidal throughhole formed in the rear, upper portion of each of the side frames and has the same thickness as the latter, and is fixedly secured to the upper side surface of an upper jaw portion of each of the side frames.

According to a third aspect of the present invention, there is provided a press machine as set forth in the above-mentioned first aspect, characterized in that the reinforcing member is an L-shaped plate member corresponding to the configuration of a zone which extends from the leading end of the lower jaw portion to the uppermost portion of the innermost upright wall of the recess, and at least two pieces of reinforcing members are superposed and fixedly secured to the zone on the inner surface of each of the side frames.

Further, according to a fourth aspect of the present invention, there is provided a press machine as set forth in the above-mentioned first aspect, characterized in that the reinforcing member is a sheet of strip-shaped plate member, and is fixedly secured to a vertically intermediate portion of the inner surface of each of the side frames along the rear edge thereof.

Yet further, according to a fifth aspect of the present invention, there is provided a press machine as set forth in the above-mentioned first aspect, characterized in that the reinforcing member is a substantially rectangular plate member, and is fixedly secured by means of bolts or by plug welding to the inner surface of each of the side frames at a plurality of places.

According to the present invention incorporating the above-mentioned aspects, the following advantages are obtained.

The press machine is effectively reinforced so as to improve the working accuracy of finished products without the need for installing any special device on the outside thereof, without increasing extremely the weight of the entire press machine, without obstructing the space between the side frames, and which is capable of reducing appreciably the level of noise generated by the machine in operation. The reinforcement is provided without creating a preload stress in the side frames so that an accuracy of the mechanisms within the press frame is maintained, and both asymmetric and symmetric vibrations are effectively suppressed.

Stating in brief, since each of the side frames is reinforced by at least one plate member at at least one suitable place, the deformation of the frame or flare of the opening formed between the upper and lower jaws of the frame which tends to occur in operation is reduced, thereby reducing vibration, and hence, the noise caused thereby, and also improving working accuracy of finished products.

The above-mentioned and other objects, aspects and advantages of the present invention will become apparent to those skilled in the art by making reference to the following description and the accompanying drawings in which preferred embodiments incorporating the principles of the present invention are shown by way of examples only.

DETAILED DESCRIPTION OF PREFERRED EMBODIMENTS

Several embodiments of the present invention will now be described in detail below with reference to FIGS. 5 to 14 of the accompanying drawings.

Figure 1:
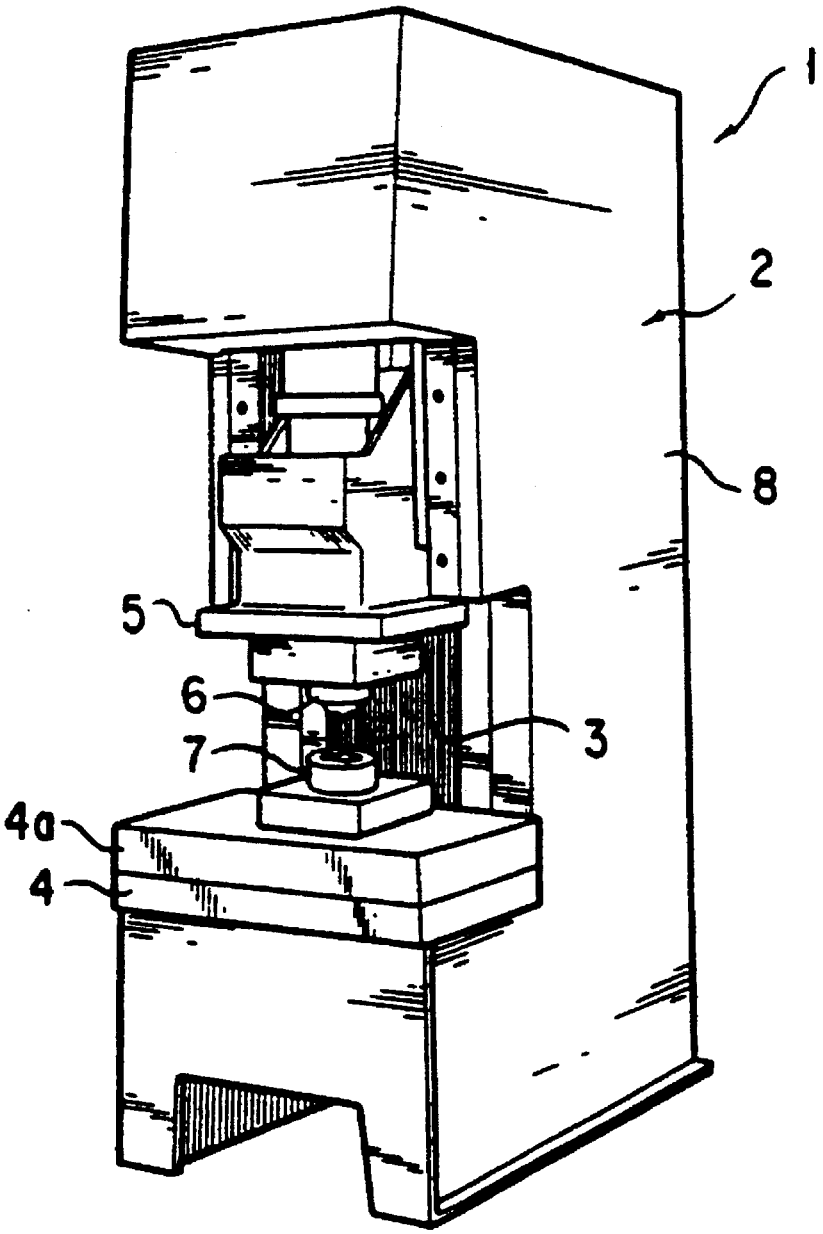
FIG. 1 is a schematic, overall perspective view showing a prior art press machine which is C-shaped in side sectional view.

A first embodiment of the present invention will be described with reference to FIG. 5. In this embodiment, the same component parts as those of the prior art example shown in FIG. 1 are denoted by the same reference numerals, and further description thereof is thus omitted.

Figure 5:
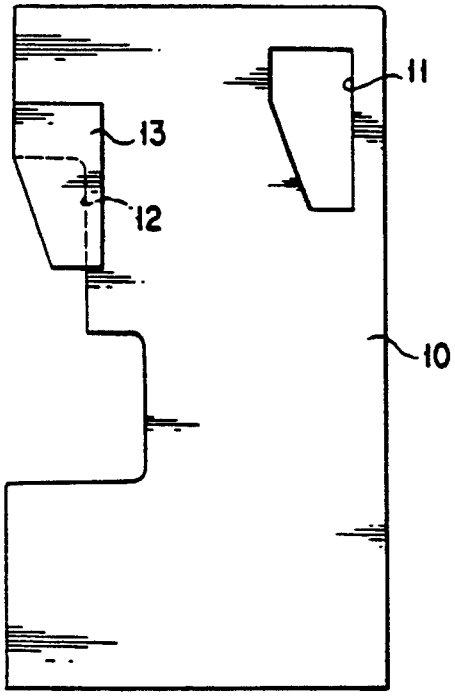
FIGS. 5, 6 and 7 are schematic interior side elevational views showing first, second and third embodiments of the present invention.

In FIG. 5, each of the left and right side frames 10 of a press machine 1 has a substantially inverted trapezoidal through-hole 11 formed in the rear, upper portion thereof. Further, each of the side frames 10 has a notched portion 12 formed above the upper jaw portion on the front side thereof. A piece of reinforcing plate 13 which is of a shape closing the side of the notched portion 12 is fixedly secured by welding to the notched portion 12. The member which is cut out from the side plate 10 to form the through-hole 11 is used as the reinforcing plate 13.

Due to the above-mentioned construction, the area of the rear, upper portion of the side frame 10, which is a principal noise and vibration generating portion, is reduced, thereby reducing the noise and vibration generated in this portion. Further, the notched portion 12 formed above the upper jaw portion, which is subjected to a high loading, is reinforced by the reinforcing plate 13 so that the amount of flare of the opening formed between the upper and lower jaws of the side frames 10 is reduced by about 10% as compared with the prior art example, thereby reducing the breakthrough noise.

The second embodiment of the present invention will be described with reference to FIG. 6.

Figure 6:
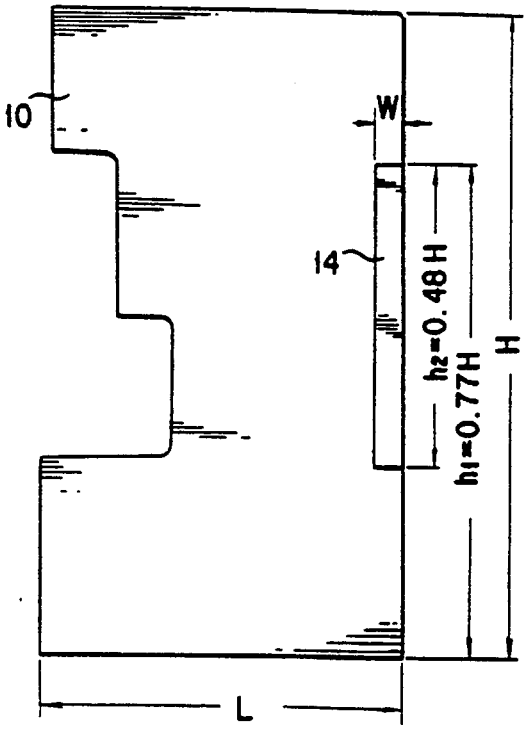

In FIG. 6, a vertically extending reinforcing plate 14 comprised of a strip-shaped plate member is fixedly secured to each of the left and right side frames 10 forming both side walls of the frame of a press machine along the rear edge of the inner surface thereof.

When the length, height and thickness of the side frame 10 are denoted by L, H and T, the width W of the reinforcing plate 14 is preferably about 0.08 L (W=0.08 L), and the thickness t of the plate 14 (which is the dimension of the plate 14 in a direction at right angles to the side frame 10) is preferably about 1.5 T (t=1.5 T). Further, the height $h_1$ of the reinforcing plate 14 at the upper end thereof is preferably about 0.77 H ($h_1$=0.77 H), and the length $h_2$ of the plate 14 in the direction of the height thereof is preferably about 0.48 H ($h_2$=0.48 H).

An example of the above-mentioned dimensions can be, L=1250 mm, T=55 mm, H=2210 mm, $h_1$=1702 mm, and $h_2$=1061 mm.

Figure 2:
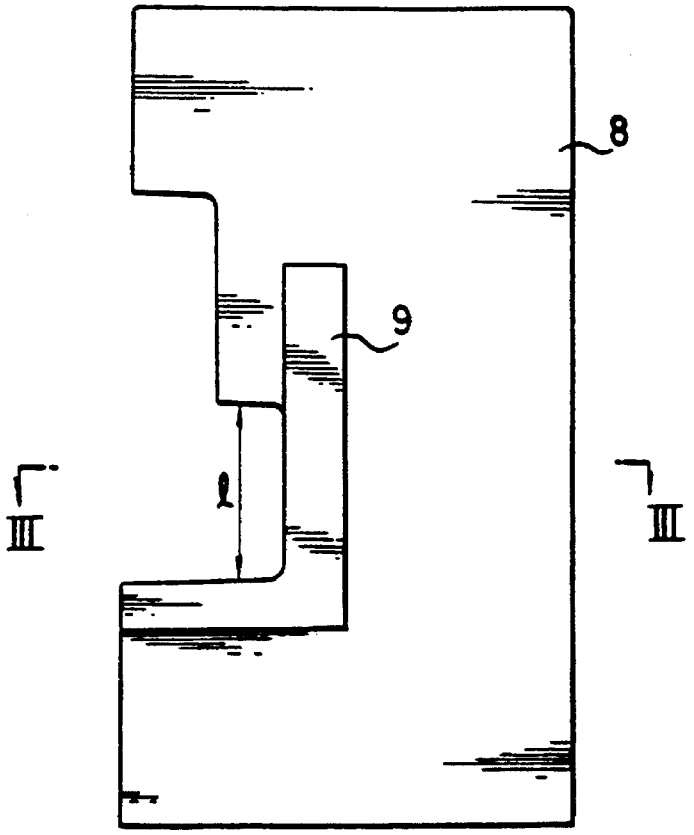
FIG. 2 is a schematic, side elevational view showing a prior art example of reinforcement of a side frame.
Figure 3:
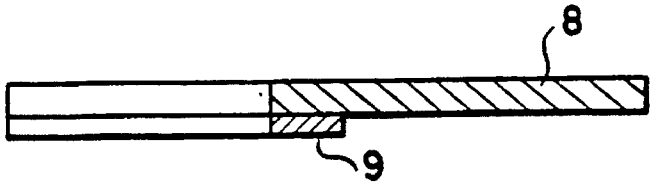
FIG. 3 is a sectional view taken along line III—III in FIG. 2.
Figure 4:
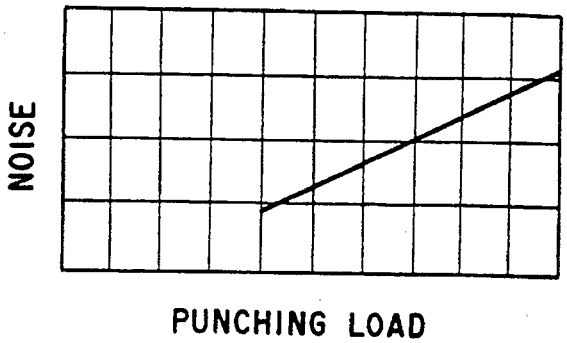
FIG. 4 is a graph showing the relationship between the punching load and the noise.

Due to the above-mentioned construction, the deformation of the frame in the transverse direction is reduced by about 10% as compared with the prior art example of FIGS. 2 and 3.

Next, the third embodiment of the present invention will be described with reference to FIGS. 7 to 9B.

Figure 7:
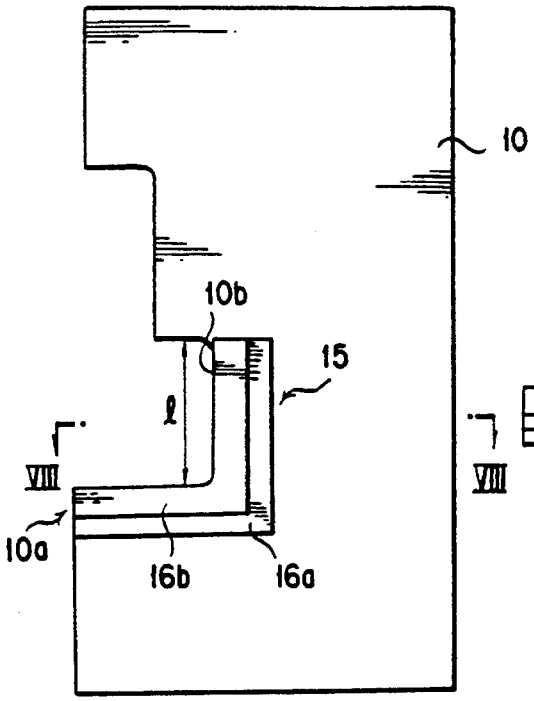
Figure 8:
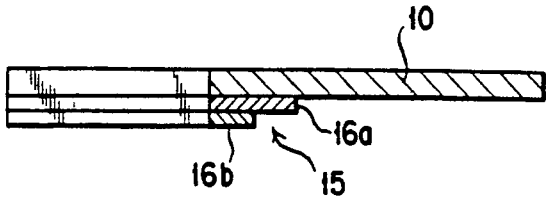
FIG. 8 is a sectional view taken along line VIII—VIII in FIG. 7.

In FIG. 7, an L-shaped reinforcing member 15 is fixedly secured to the inner surface of each of the side frames 10 so as to extend from a leading end of a lower-jaw portion 10*a* of the C-shaped member to the top of a press operation zone 10*b*. The reinforcing member 15 has a height ι which corresponds to the height of the innermost upright wall of the recess.

The reinforcing member 15 is comprised of a first reinforcing member 16*a* and a second reinforcing member 16*b* which are superposed and fixedly secured in two layers.

Figure 9A:
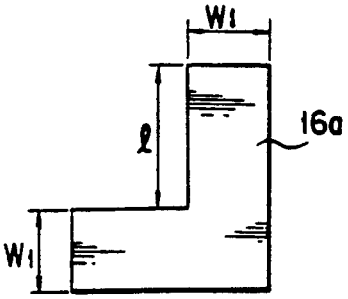
FIGS. 9A and 9B are plan views showing reinforcing members used in the embodiment shown in FIG. 7.
Figure 9B:
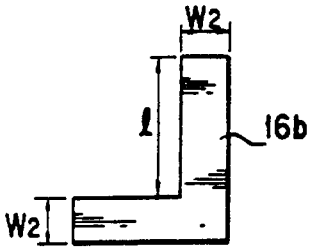

These reinforcing members 16*a* and 16*b* are formed as shown in FIGS. 9A and 9B, respectively. When the height of the press operation zone of the side frame 10 is denoted by ι, the widths $W_1$ and $W_2$ of the reinforcing members 16*a* and 16*b* are as follows:

$$W_1=\tfrac{1}{2}\,\iota,\ W_2=\tfrac{1}{3}\,\iota$$

The ratio of the thickness $t_1$ of the reinforcing member 16*a* to the thickness $t_2$ of the reinforcing member 16*b* is as follows:

$$t_1:t2=1:2.2$$

One example of the actual dimensions of the reinforcing members 16*a*, 16*b* can be, ι=450 mm, $W_1$=225 mm, $W_2$=150 mm, $t_1$=32 mm, and $t_2$=70 mm.

In the above-mentioned construction, the frame is reinforced by the first and second reinforcing members 16*a* and 16*b* to withstand the loading exerted thereon, which tends to flare the frame.

Next, the fourth embodiment of the present invention and a variant example thereof will be described with reference to FIGS. 10 to 14.

Figure 10:
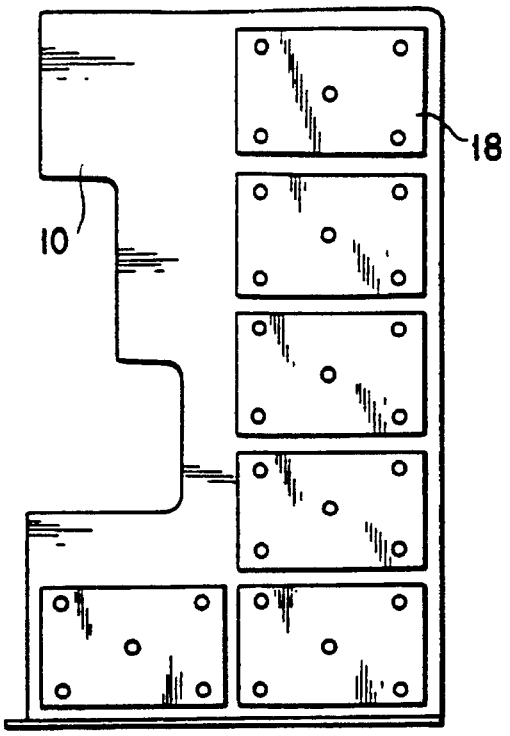
FIGS. 10 and 11 are schematic interior side elevational views showing a fourth embodiment of the present invention and its variant example.
Figure 11:
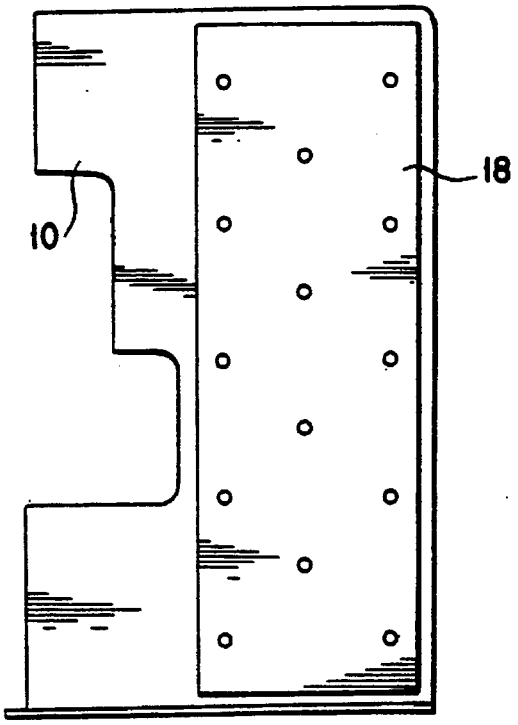

FIGS. 10 and 11 each show only one of the side frames 10 of the press machine. A substantially rectangular plate member 18 (or members 18) is (are) fixedly secured to the inner surface of the side frame 10 which is C-shaped in side view.

Figure 12:
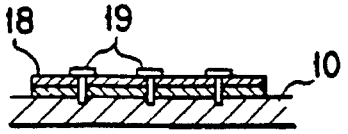
FIGS. 12 and 13 are fragmentary sectional views showing two examples of reinforcing members for use in the embodiments shown in FIGS. 10 and 11 which are fixedly secured to the side frames.
Figure 13:
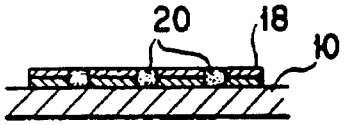

There are two examples of the arrangement of the plate member 18 (or members 18). In one example, as shown in FIG. 10, a plurality of plate members 18 each having a small area are fixedly secured to the side frame at a plurality of places. In another example, as shown in FIG. 11, a single piece of plate member 18 having a large area is fixedly secured to the side frame 10 with the longer side thereof extending in the vertical direction. Further, a piece of plate member 18 whose thickness is about one-tenth of that of the side frame 10 or a plurality of separate plate members 18 are fixedly secured in a single layer to the side frame 10. Alternatively, a plurality of superposed plate members 18 each having the same thickness are fixedly secured in the form of one-piece or separate pieces to the side frame 10 as shown in FIGS. 12 and 13. Further, in respect of fixing means, the superposed plate members 18 are fixedly secured by means of bolts 19 to the side frame 10 at a plurality of places, as shown in FIG. 12, or they are fixedly secured by plug welding 20 to the side frame 10 at a plurality of places, as shown in FIG. 13. Preferably the total area of the bolts 20 or the plug welded joints is about 5 to 6% of the surface area of the plate member(s) 18.

In the above-mentioned construction, when vibration is propagated to the side frame 10, the side frame 10 will vibrate together with the plate member 18 (or members 18) fixedly secured thereto. At that time, because both the side frame 10 and the plate member 18 (or members 18) have different natural frequencies and both the members 10 and 18 are fixedly secured to each other at a plurality of places, and held only in contact with each other in the remaining portions, the above-mentioned vibration causes the members 10 and 18 to strike or chafe against each other in the contact portions. Such striking or chafing energy will give a vibration damping effect so that the above-mentioned vibration energy is absorbed into the side frames as heat energy, thereby suppressing the vibration. Thus, the present invention relies on a vibration damping technique which converts vibrations into heat energy and disperses it into the structure itself.

In contrast to the prior art (JP 55-46399) device which has tie rods extending between the side frames and relies on an increased stiffness in the structure to reduce vibration effects, the plate member(s) 18 of the present invention are effective against both symmetric vibrations (the side frames moving in opposing directions) and asymmetric vibrations (both side frames moving in the same direction in phase with each other). Moreover, as is clear from FIGS. 10 to 13 of the drawings, the superposed plate members 18 do not obstruct a space between the side frames 10, as do the tie rods 2 in the '399 device. The plate members 18 provide a means for suppressing vibrations in the side frames 10 while leaving the space between the side frames open for accommodating the most suitable arrangements and sizes of punching and pressing mechanisms (e.g., driving, lubricating, and controlling mechanisms, and the like). As used in this application, the phrase "without obstructing a space between the side frames" means without having a member extending between and connected to the two side frames, such as the tie rods 2 of the '399 device.

Moreover, with the reinforcing plates 18 of the present invention it is not necessary to apply a preload to the side frames. This eliminates the inconveniences resulting from the repositioning of the mechanisms within the press machine of the '399 device after the preloading is applied by the tie rods 2.

Figure 14:
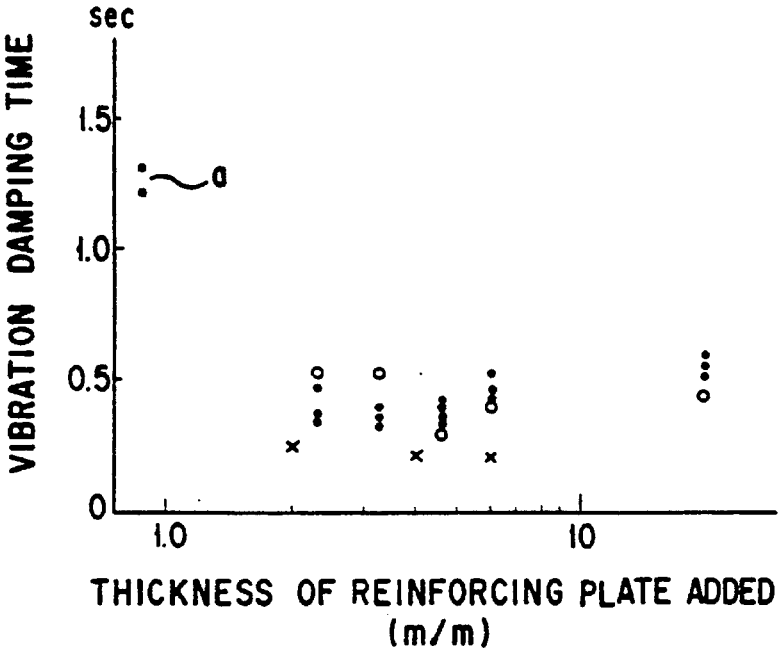
FIG. 14 is a graph showing the result of vibration damping experiments conducted in relation to the embodiments shown in FIGS. 10 and 11.

Experimental results on the degree of the abovementioned damping of vibration are shown in FIG. 14. In this drawing, reference characters "a" indicate the result obtained when side frames only 14 mm thick are provided, black dots indicate the result obtained when plate members are fixedly secured by plug welding to each of side frames, white dots indicate the result obtained when plate members are fixedly secured by means of bolts to each of the side frames, and X marks indicate the result obtained when prior art vibration damping materials were used.

As is apparent from this graph, the construction according to the present invention could provide nearly the same vibration damping effect as that obtained by the construction using the prior art vibration damping material.

The foregoing description is merely illustrative of preferred embodiments of the present invention, and the scope of the present invention is not to be limited thereto. It will readily occur to those skilled in the art many changes and modifications of the present invention without departing from the scope of the present invention.

What is claimed is:

1. A press machine having a frame, comprising:

first and second C-shaped side frames, said side frames each having a front opening defined by a lower jaw portion and an upper jaw portion;

a bolster mounted on said lower jaw portion of the side frames;

a slide member provided for the upper jaw portion of the frame;

a driving system mounted on the upper jaw portion for driving said slide member; and means for suppressing vibrations in said side frames without obstructing a space between said side frames, said vibration suppressing means comprising at least one reinforcing member fixedly secured to each of said side frames at at least one predetermined place so as to suppress the deformation of the front opening of side frames, said at least one reinforcing member comprising at least one substantially rectangular plate member fixedly secured to each of the side frames at a plurality of places.

2. A press machine as claimed in claim 1, wherein said at least one reinforcing member comprises a plurality of plate members fixedly secured to each of the side frames at a plurality of places, said plurality of plate members together covering a majority of the surface area of one side of each of said side frames.

3. A press machine as claimed in claim 2, wherein each of said plate members are fixedly secured to said side frames by plug welded joints, said plug welded joints having a total area of about 5 to 6 percent of a total surface area of one side of said plate members.

4. A press machine as claimed in claim 2, wherein each of said plate members are fixedly secured to said side frames by bolts extending through apertures in said plate members.

5. A press machine as claimed in claim 1, wherein said at least one rectangular plate member comprises a plurality of plate members.

6. A press machine as claimed in claim 5, wherein said plurality of plate members are laid one on top of another.

7. A press machine having a frame, comprising:

first and second C-shaped side frames, said side frames each having a front opening defined by a lower jaw portion and an upper jaw portion, said first and second side frames being spaced apart;

a bolster mounted on said lower jaw portion of the side frames;

a slide member provided for the upper jaw portion of the frame;

a driving system mounted on the upper jaw portion for driving said slide member; and means for suppressing vibrations in said side frames consisting of at least one substantially rectangular reinforcing plate member fixedly secured to each of said side frames at a plurality of places so as to suppress the deformation of the from opening of said side frames, wherein said at least one reinforcing plate member comprises a plurality of plate members fixedly secured to each of the side frames at a plurality of places, said plurality of plate members together covering a majority of the surface area of one side of each of said side frames.

8. A press machine having a frame, comprising:

first and second C-shaped side frames, said side frames each having a front opening defined by a lower jaw portion and an upper jaw portion, said side frames being spaced apart;

a bolster mounted on said lower jaw portion of the side frames;

a slide member provided for the upper jaw portion of the frame;

a driving system mounted on the upper jaw portion for driving said slide member; and a plurality of vibration suppressing members for converting vibration energy of said side frames into thermal energy, said vibration suppressing members comprising at least one substantially rectangular reinforcing plate member fixedly secured to each of said side frames so as to cover an intermediate portion of each of said side frames;

wherein said at least one reinforcing plate member comprises a plurality of plate members fixedly secured to each of the side frames at a plurality of places, said plurality of plate members together covering a majority of the surface area of one side of each of said side frames.

* * * * *